United States Patent [19]

Kraska

[11] 4,093,102

[45] June 6, 1978

[54] END PANEL FOR CONTAINERS

[75] Inventor: John L. Kraska, Riverside, Ill.

[73] Assignee: National Can Corporation, Chicago, Ill.

[21] Appl. No.: 500,706

[22] Filed: Aug. 26, 1974

[51] Int. Cl.[2] ..... B65D 7/44

[52] U.S. Cl. ..... 220/67; 220/66

[58] Field of Search ..... 220/66, 67, 70, 355

[56] References Cited

U.S. PATENT DOCUMENTS

| | | | |
|---|---|---|---|
| 2,234,485 | 3/1941 | Connor | 220/355 |
| 2,894,844 | 7/1959 | Shakman | 220/66 |
| 3,383,006 | 5/1968 | Knize | 220/355 |
| 3,400,853 | 9/1968 | Jacobsen | 220/66 |
| 3,409,167 | 11/1968 | Blanchard | 220/66 |
| 3,417,898 | 12/1968 | Bozek et al. | 220/66 |
| 3,690,507 | 9/1972 | Gailus et al. | 220/66 |
| 3,770,161 | 11/1973 | Knize | 220/355 |
| 3,843,014 | 10/1974 | Cospen et al. | 220/66 |

*Primary Examiner*—William T. Dixson, Jr.

*Assistant Examiner*—Allan N. Shoap

*Attorney, Agent, or Firm*—Robert A. Stenzel; Ralph R. Rath

[57] ABSTRACT

An end panel for a container is specifically configured to be able to substantially reduce the metal thickness without sacrificing resistance to bulging and buckling of the panel when subjected to high internal pressures. The end panel consists of a central portion that has an outwardly directed annular bead around the periphery thereof which is connected to a countersink or inwardly directed bead along a flat first wall portion. The outer end of the countersink or inwardly directed bead has a second flat wall portion, the outer end of which is connected to a peripheral curl by a third flat wall portion and the curl is adapted for seaming the end panel to a container body. The first and third flat wall portions of the panel define small acute angles with respect to a vertical plane that extends perpendicular to the central panel portion while the second flat wall portion defines an angle of less than 4° with respect to the vertical plane.

6 Claims, 3 Drawing Figures

END PANEL FOR CONTAINERS

BACKGROUND OF THE INVENTION

The present invention relates to container end panels, particularly of the type that are used for the packaging of products under high pressure, such as beer and/or carbonated beverages. In recent years, many foods and beverages, particularly carbonated beverages and beer, have commonly been packaged in metal containers formed of either aluminum or steel.

In the manufacture of such containers for packaging foods and beverages, it is essential that the containers be formed of a minimum thickness of metal so that the container can be marketed at a competitive price. The cost of the container is extremely important since, for many products, the cost of the container approaches or exceeds the cost of the product being packaged therein. As such, any reduction in cost of manufacturing containers is extremely desirable.

Furthermore, because of the large market for metal containers, particularly those formed of aluminum, a very small savings in the amount of material for a single can will produce a substantial difference in price in considering a normal order from a packager, which may include hundreds of thousands of containers. Thus, if the container manufacturer can reduce the thickness of the metal utilized in forming the container by even one-thousandths of an inch, the cost savings can be substantial.

In more recent years, many beverages have been packaged in what is commonly referred to as a two-piece container. In this container, the bottom wall and side wall of the container are formed as an integral unit by drawing and ironing or extruding a flat blank to produce a container open at one end. The open end of the container then has an end panel secured thereto by a conventional seaming process.

These types of containers must be capable of withstanding pressures on the order of 90 p.s.i. minimum without having any portion of the container buckle.

Various proposals have been made for increasing the resistance to buckling of an end panel by particular configurations of the end panel. One example of such configuration is disclosed in U.S. Pat. No. 3,417,898, issued Dec. 24, 1968.

Since even a small reduction in metal thickness for either the container end panel or the container body can result in significant savings, container manufacturers are constantly striving for reducing the amount of metal required for producing the container, without sacrificing any of the characteristics, such as reduced buckling pressure.

SUMMARY OF THE INVENTION

According to the present invention, a container end panel is specifically configured so as to be capable of withstanding pressures on the order of 90 p.s.i. minimum while still reducing the metal thickness of the end panel by substantially more than 10%. This is accomplished by particularly configuring the peripheral portion of the end panel adjacent the curl or flange which is utilized for seaming the end panel to the container body.

More specifically, the end panel of the present invention consists of a central flat portion having a peripheral bead integrally joined around the periphery thereof and this bead is in turn connected to an inwardly directed bead or countersink by a flat wall portion. The periphery of the outwardly directed bead is connected to the curl or flange on the periphery of the end panel by second and third flat wall portions. The first and third wall portions define small acute angles with respect to a plane that extends perpendicular to the flat central panel portion while the second flat wall portion defines an angle of less than 4° with respect to the vertical plane.

With the particular configuration of the end panel as described above, when pressure is applied to the inside surface of the end panel, the flat wall portions tend to move and the angles with respect to the perpendicular plane are reduced thereby increasing the resistance of the container end panel to forces which tend to buckle the panel.

DETAILED DESCRIPTION

Figure 1:
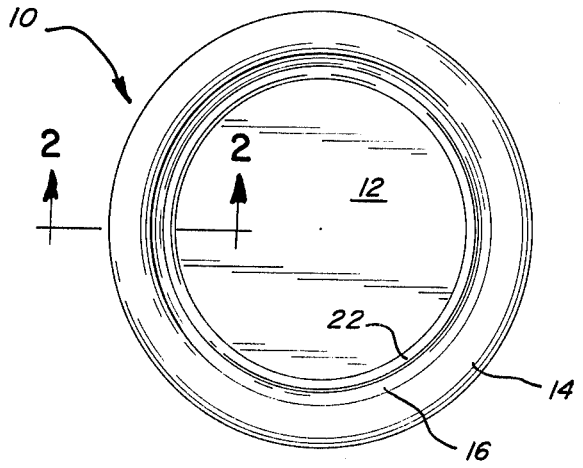
FIG. 1 shows a plan view of an end panel constructed in accordance with the teachings of the present invention.
Figure 2:
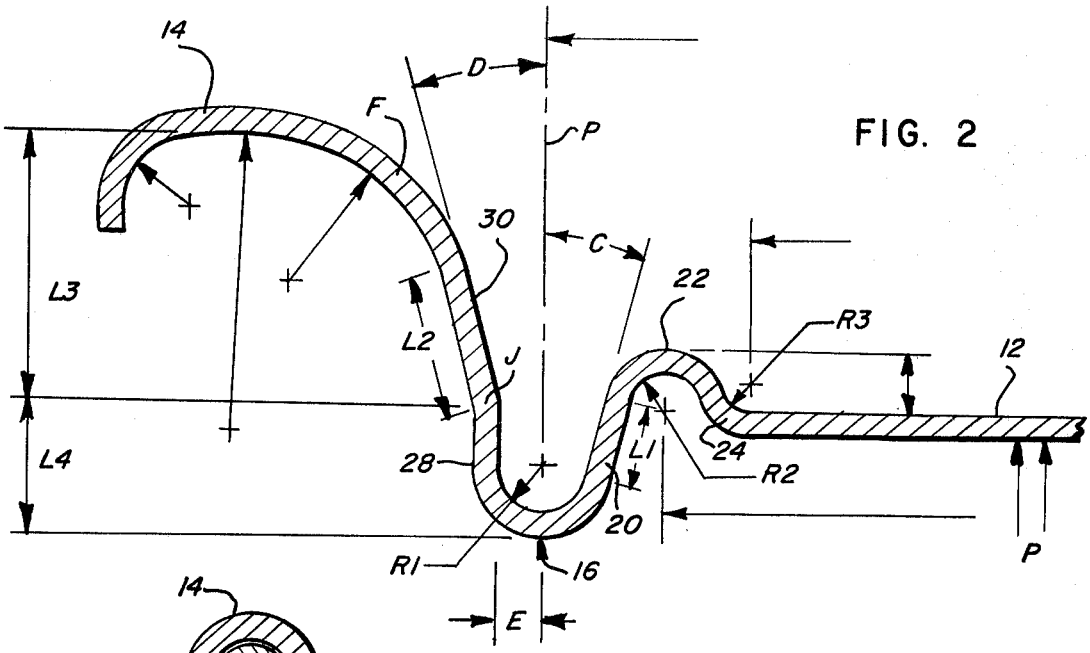
FIG. 2 is an enlarged fragmentary sectional view as viewed along line 2—2 of FIG. 1.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings discloses end panel 10 constructed in accordance with the teachings of the present invention. Panel 10 is configured to be able to reduce the metal thickness of a commercially known end formed of aluminum by more than 10% without decreasing the resistance of the end to bulging or buckling.

Figure 3:
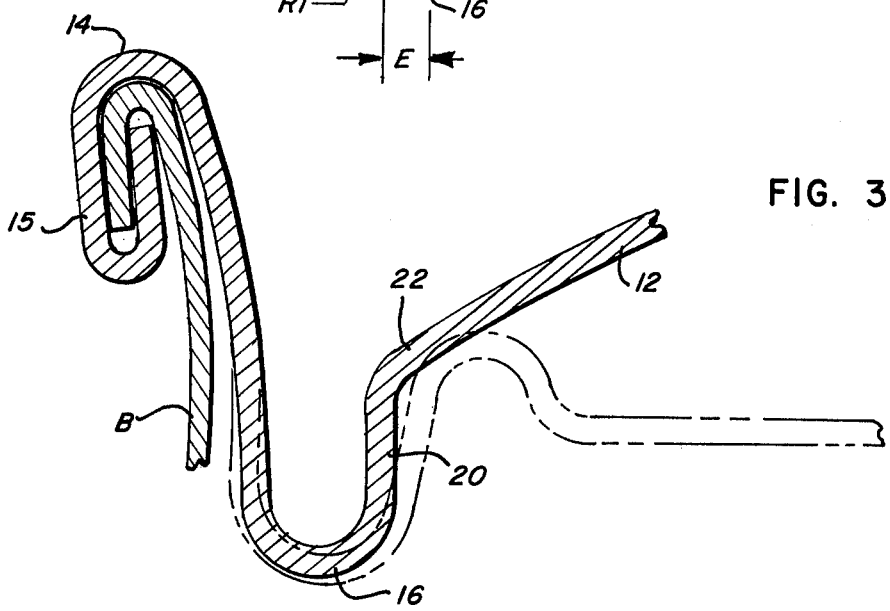
FIG. 3 is a view similar to FIG. 2 showing the configuration of the panel as pressure is applied to the internal surface of the panel which forms part of the container.

End panel 10 has a central flat panel portion 12 and a peripheral curl or flange 14 on the periphery thereof which is adapted to be seamed to a cylindrical container body B in the usual manner by a double seam 15 (FIG. 3). End panel 10 has a countersink or inwardly directed bead 16 that consists of an arcuate portion having a radius R1 which will be described in more detail later.

According to the present invention, the areas on opposite sides of the countersink or inwardly directed bead 16 are configured so that the resistance to buckling or bulging is increased as pressure P is applied to the internal surface of central portion 12. More specifically, the inner edge of bead 16, which is annular in plan view, has a flat wall portion 20 integral with the inner end of bead 16. The opposite end of flat wall portion 20, which has a length L1, is integrally joined with central panel portion 12 through an outwardly directed bead 22 having a radius R2, which is connected to central panel portion 12 by an arcuate portion 24 having a radius R3. First wall portion 20 defines an angle C with respect to a vertical plane P that extends perpendicular to central panel 12.

The area between counter sink 16 and peripheral curl or flange 14 includes a second flat wall portion 28 and a third flat wall portion 30, which have adjacent ends integral with each other at juncture J. Third wall portion 30 has a length L2 and defines an angle D with respect to vertical plane P while second flat wall portion 28 defines angle E with respect to plane P. Also, the length of flat wall portion 28 and the dimension of radius R1 are selected so that juncture J is spaced a distance L4 from the lower edge of countersink 16 along plane P. Dimension L3 defines the vertical dimension of curl 14 and flat wall portion 28 along plane P.

It has been determined that by proper selection of angles C, D and E as well as the radii R1, R2 and R3, and dimensions L1, L2, L3 and L4 the resistance to outward movement of central panel portion 12 will be substantially increased as pressure P to the internal surface of central panel portion 12 is increased up to a certain point.

It has also been determined that three dimensions and angles can be selected so that standard commercial seaming tools having a certain size chuck can still be utilized to seam the end panel to a container body.

More specifically, increased pressure resistance to buckling of the panel is obtained by the combination of the first and second flat wall portions 26, 28 on opposite sides of countersink 16 and bead 22 at the end of wall portion 20 with the second flat wall portion 28 defining an angle of less than 4° with respect to plane P.

With this arrangement, bead 22 and flat wall portion 28 cooperate with flat wall portion 20 to decrease the angle C as the pressure on the internal surface of container end panel 12 is increased. Also, at the same time, because the only fixed point for the panel 10 is generally adjacent the inner edge of curl or flange 14, indicated by the reference numeral F, the entire bead or countersink 16 will have a tendency to move outwardly causing a reduction in angle D for flat wall portion 30. This phenomena is most clearly shown in solid lines in FIG. 3 wherein central panel portion has been shown as being bulged outwardly beyond the upper edge of flange 14. It will be appreciated that such positioning of the panel portion of end panel 10 would not occur until a substantial amount of pressure, substantially more than 100 p.s.i.g., has been applied to the internal surface of central panel 12.

Summarizing the above, the cooperation between flat wall portions 20 and 28 as well as upwardly directed bead 22 will significantly increase the resistance of the panel 10 to pressures which would cause buckling of the panel. It has been determined that end panel 10 can be formed from a metal blank having a thickness of 0.0115 inches as opposed to 0.0135 inches (the thickness for aluminum ends presently being commercialized) without any reduction in buckling pressure when the ends have been configured as described above.

The above identified radii R1–R3 and the lengths L1–L4 as well as angles C and D are significant in maintaining the desired pressure resistance while at the same time can be selected so that present commercial seamers with standard chucks can be used to seam panel 10 to container body B and the ends can still be nested for packaging and shipment.

While not specifically limited to any particular dimensions, a specific example of an aluminum end having a thickness of 0.0115 inches and being capable of resisting buckling to a pressure of approximately 100 p.s.i. within the container would have the following dimensions for the various independent variables and these dimensions may have the following ranges:

| Dimension | Specific Example (Ideal) | Range |
|---|---|---|
| R1 | 0.032 | .028–.034 |
| R2 | 0.025 | .025–.030 |
| R3 | 0.018 | .018–.022 |
| Angle C | 15° | 12° 15° |
| Angle D | 15° | 14° 16° |
| Angle E | 0° | 0° 3° |
| L1 | .065 | 0.065–0.075 |
| L2 | .100 | 0.100–0.110 |
| L3 | .168 | 0.164–0.174 |
| L4 | 0.090 | 0.080–0.094 |

As can be appreciated from the above description, the present invention results in a significant savings in the amount of metal that is utilized for the formation of an end panel without sacrificing resistance of the panel to buckling pressures. Such a significant decrease in the amount of metal utilized, which is more than 10 per cent when compared to standard commercially available aluminum ends, will result in savings of millions of dollars for container manufacturers.

While the present invention has been described specifically in connection with an aluminum end, it will be appreciated that the same cost savings may be appreciated if the configuration of the end panel were utilized for steel ends as well.

What is claimed is:

1. An end panel for containers consisting of a panel having a substantially flat central panel portion, a first bead surrounding said central panel portion and comprising an inverted U-shaped arcuate portion extending from and raised above said central panel and extending downwardly into a first flat wall portion, said first bead having a first radius and said first flat wall portion defining an angle greater than 10° and less than 16° with respect to a plane extending perpendicular to said flat central portion, a second bead extending from the outer end of said first flat wall portion and comprising a U-shaped portion, said first flat wall portion having a length sufficient to locate said second bead entirely below the level of said central panel, a second flat wall portion extending upwardly from said second bead, said second flat wall portion defining an angle less than 4° with respect to said plane, a third flat wall portion integral with an outer edge of said second flat wall portion, said third flat wall portion defining an angle in the range of 14 to 16° with respect to said plane, said second bead and said second flat wall portion being dimensioned so that the distance along said plane between the juncture of said second and third flat wall portions and the peripheral edge of said second bead is in the range of 0.080 0.094 inches, and a peripheral curl on the periphery of said third flat wall portion adapted to be seamed to a container body so that pressure applied to said central panel portion will vary said angles and thereby increase the resistance of said end to buckling. --

2. An end panel as defined in claim 1, in which said second bead has a radius in the range of 0.028 to 0.034 inches.

3. An end panel as defined in claim 2, in which said second bead has a radius of 0.032 inches and said distance along said plane is about 0.090 inches.

4. An end panel as defined in claim 3, in which said first and third flat wall portions each define an angle of approximately 15° with respect to said plane.

5. An end panel as defined in claim 1, in which said first flat wall portion has a length in the range of 0.065 inches and said third flat wall portion has a length in the range of 0.100 to 0.110 inches.

6. An end panel as defined in claim 5, in which said first radius is in the range of 0.025 to 0.030 inches and said second bead has a radius in the range of 0.028 to 0.034 inches.

* * * * *